US010457070B2

(12) United States Patent
LeFevre et al.

(10) Patent No.: US 10,457,070 B2
(45) Date of Patent: Oct. 29, 2019

(54) SYSTEM FOR TREATING THE SURFACES OF THREE-DIMENSIONAL (3D) OBJECTS PRIOR TO PRINTING THE SURFACES

(71) Applicant: Xerox Corporation, Norwalk, CT (US)

(72) Inventors: Jason M. LeFevre, Penfield, NY (US); Paul J. McConville, Webster, NY (US); Chu-heng Liu, Penfield, NY (US); Erwin Ruiz, Rochester, NY (US); James A. Winters, Alfred Station, NY (US)

(73) Assignee: Xerox Corporation, Norwalk, CT (US)

( * ) Notice: Subject to any disclaimer, the term of this patent is extended or adjusted under 35 U.S.C. 154(b) by 193 days.

(21) Appl. No.: 15/482,100

(22) Filed: Apr. 7, 2017

(65) Prior Publication Data

US 2018/0290172 A1 Oct. 11, 2018

(51) Int. Cl.

| | |
|---|---|
| ***B41J 3/407*** | (2006.01) |
| ***B41J 11/00*** | (2006.01) |
| ***B05C 9/10*** | (2006.01) |
| *B05D 3/04* | (2006.01) |

(52) U.S. Cl.

CPC ..... *B41J 3/4073* (2013.01); *B05C 9/10* (2013.01); *B41J 11/0015* (2013.01); *B05D 3/0493* (2013.01)

(58) Field of Classification Search

CPC ... B41J 3/4073; B41J 11/0015; B05C 1/0808; B05C 21/00; B05C 9/10; B05D 3/0493; B41M 5/0011

USPC ..... 118/211, 50, 72, 73

See application file for complete search history.

(56) References Cited

U.S. PATENT DOCUMENTS

| | | | | |
|---|---|---|---|---|
| 4,511,323 | A * | 4/1985 | Blaum | B29C 59/043 425/385 |
| 6,620,251 | B2 * | 9/2003 | Kitano | B08B 7/0057 118/50 |
| 7,137,426 | B2 | 11/2006 | Neri et al. | |
| 8,557,355 | B2 | 10/2013 | Hann et al. | |
| 2002/0131062 | A1 | 9/2002 | Neri et al. | |
| 2010/0119739 | A1 | 5/2010 | Beck et al. | |
| 2015/0182997 | A1 | 7/2015 | Balantrapu et al. | |

* cited by examiner

*Primary Examiner* — Laura Edwards

(74) *Attorney, Agent, or Firm* — Maginot Moore & Beck LLP

(57) ABSTRACT

An object surface treatment system facilitates the treatment of articles of manufacture before they are printed. The system includes a chamber having walls and a lid configured to close the chamber, a flexible member mounted to the lid of the chamber, a vacuum source operatively connected to an interior volume of the chamber, and a plurality of actuators. A controller is configured to operate the actuators and vacuum source to move the applicator to apply a chemical to the flexible member, move the lid to close the chamber, produce a vacuum within the chamber and move a portion of the surface of the flexible member into engagement with a surface of an object within the chamber, cease operation of the vacuum source to enable the flexible member to return to a position adjacent the lid, and remove the lid from the chamber for removal of the object from the chamber.

7 Claims, 4 Drawing Sheets

SYSTEM FOR TREATING THE SURFACES OF THREE-DIMENSIONAL (3D) OBJECTS PRIOR TO PRINTING THE SURFACES

TECHNICAL FIELD

This disclosure relates generally to a system for printing on three-dimensional (3D) objects, and more particularly, to systems for preparing the surfaces of such objects prior to printing.

BACKGROUND

Printers have been developed that can print text and graphics with multiple colors on the surface of 3D objects. These printers enable a small number of objects, even a single object, to have indicia and text printed on their surfaces. These printers are particularly advantageous in retail environments where unprinted objects can be kept and then printed to provide customized appearances to the objects. This flexibility enables an unprinted inventory of objects, such as various types of balls used in various sports, to be kept at the location and then printed with the logos of particular teams. Consequently, an inventory of objects with a particular logo or color scheme is not required.

One issue arising from the printing of such objects is the adherence and durability of the ink used to print the text, graphics, and other indicia on the objects. Various chemical treatments are available for treating the surfaces of the objects immediately prior to printing the objects, but the application of the treatments can be problematic. For example, in some environments, the chemical or chemicals are applied by hand to the objects. Such applications, however, can be irregular and produce inconsistent results on the object surfaces. Some of the treating chemicals need to be applied with tolerances of 0.5 to 5 μm. Otherwise, image quality or image durability issues may arise. Additionally, some chemicals useful for surface treatment can irritate skin and cannot be applied manually. Providing an automated object surface treatment device would therefore be useful and beneficial.

SUMMARY

An object treatment system that improves the image quality and durability of images on 3D objects includes an applicator, a chamber having walls to form an interior volume and a lid configured to close the chamber, a flexible member mounted to the lid of the chamber, a vacuum source operatively connected to the interior volume of the chamber, a plurality of actuators, one of the actuators being operatively connected to the applicator and another of the actuators being operatively connected to the lid, and a controller operatively connected to the plurality of actuators and the vacuum source. The controller is configured to operate the one actuator to move the applicator to apply a chemical to a surface of the flexible member, to operate the other actuator to move the lid to close the chamber, to operate the vacuum source to produce a vacuum within the interior volume of the chamber and move a portion of the surface of the flexible member into engagement with a surface of an object within the interior volume of the chamber, to cease operation of the vacuum source to enable the flexible member to return to a position adjacent the lid, and to operate the other actuator to remove the lid from the chamber to enable removal of the object from the chamber.

A method of operating an object treatment system that improves the image quality and durability of images on 3D objects includes operating with a controller an actuator operatively connected to an applicator to move the applicator to apply a chemical to a surface of a flexible member mounted to a lid configured to seal a chamber having walls that form an interior volume, operating with the controller with another actuator to move the lid to close the chamber, operating with the controller a vacuum source to produce a vacuum within the interior volume of the chamber and move a portion of the surface of the flexible member into engagement with a surface of an object within the interior volume of the chamber, cease operation of the vacuum source with the controller to enable the flexible member to return to a position adjacent the lid, and operate the other actuator to remove the lid from the chamber to enable removal of the object from the chamber.

BRIEF DESCRIPTION OF THE DRAWINGS

The foregoing aspects and other features of an object surface treatment system that prepares the surfaces of 3D objects for printing are explained in the following description, taken in connection with the accompanying drawings.

DETAILED DESCRIPTION

Figure 1:
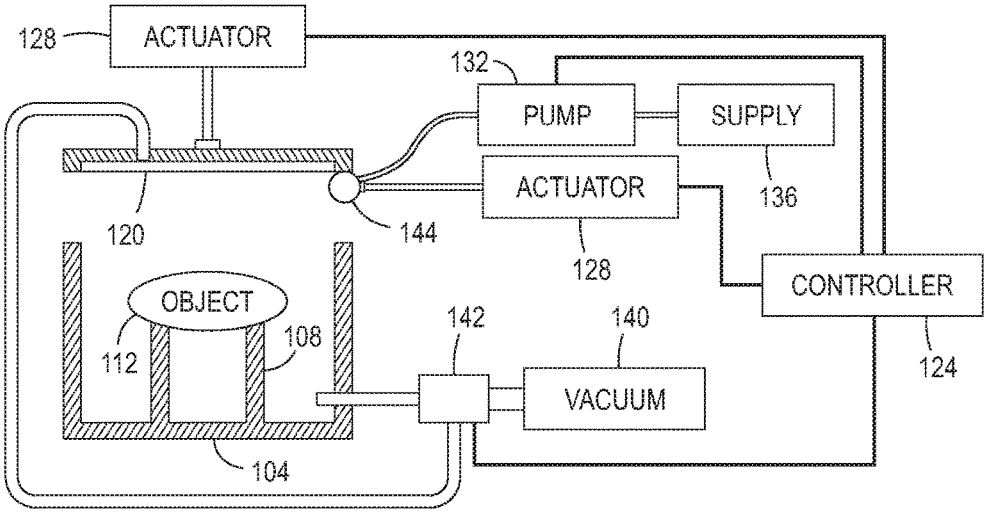
FIG. 1 illustrates an initial configuration of a system 100 used to treat the surface of a 3D object prior to printing of an image on the 3D object.

For a general understanding of the present embodiments, reference is made to the drawings. In the drawings, like reference numerals have been used throughout to designate like elements.

FIG. 1 illustrates one embodiment of a system 100 configured to treat the surface of a 3D object with chemicals prior to printing an image on the object surface. The system 100 includes a chamber 104 having rigid walls and a rigid lid 116 that enclose an interior volume within the chamber. Within the chamber 104 are one or more members 108 that form a support for an object 112 that is treated by the system 100. The lid 116 is configured to fit snugly with the walls of the chamber 104 to enable a seal to be formed sufficiently that a vacuum can be formed in the chamber. Mounted to the lid 116 is a flexible member 120. A controller 124 is operatively connected to one or more actuators 128, pump 132, and valve 142, and is configured to operate these components as described below. The controller 124 is configured with programmed instructions stored in a memory operatively connected to the controller so the controller can execute the programmed instructions to operate components in the system 100. In one embodiment, the vacuum source is configured to produce a vacuum of about 10 psi to about 15 psi within the interior volume of the chamber. A source of a surface treatment chemical is pneumatically connected to the applicator 144 through the pump 132. Alternatively, applicator 144 can be a hollow applicator, such as a roller, with an interior cavity that is filled with a treatment chemical. The chemical seeps outwardly from the cavity to the surface of the applicator as chemical is removed from the applicator surface.

Figure 2:
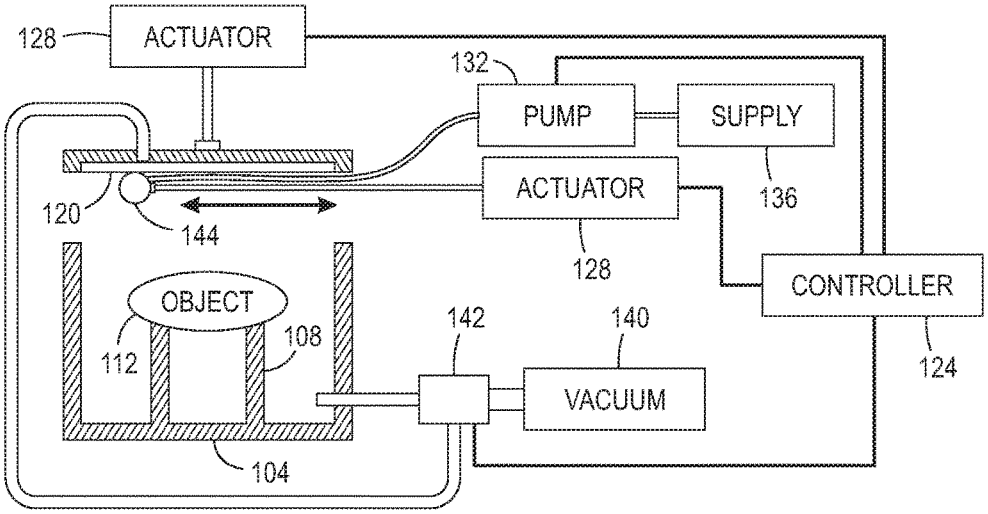
FIG. 2 illustrates the application of a surface treatment substance to a flexible member within a chamber of the system 100.

After an object has been placed within the chamber 104 for treatment as shown in FIG. 2, the controller 124 operates the actuator 128 operatively connected to the applicator 144 to move the applicator across the surface of the flexible member 120. The applicator 144 can be a roller configured to receive a treatment chemical from a source, such as supply 136 or an internal cavity, and apply the chemical to the surface of the flexible member 120. One such roller is an anilox roller. Other applicator configurations, such as a foam pad, can also be used. The actuator 128 connected to the applicator 144 is configured to move the applicator bidirectionally so the applicator can be moved while it contacts the surface of the flexible member 120 and then returned to its initial position. As the applicator 144 is being moved toward the flexible member 120, the controller 124 operates the pump 132 to pull the chemical from the source 136 and direct it to the applicator 144. After the controller 124 has operated the actuator 128 to apply the chemical to the surface of flexible member 120 with the applicator 144, the controller 124 returns the applicator 144 to its initial position and terminates operation of the pump 132. In embodiments in which the applicator includes an internal supply, the applicator is moved without operating the pump 132.

Figure 3:
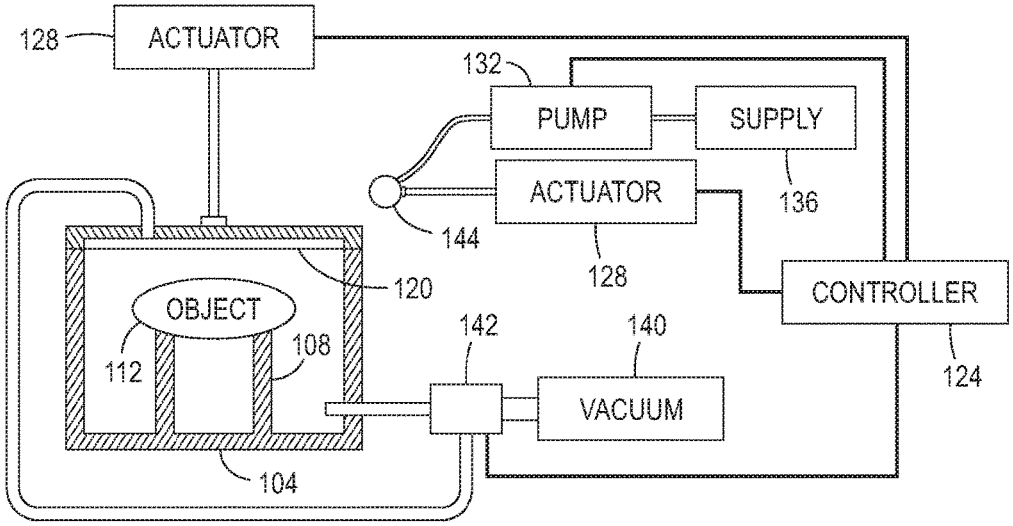
FIG. 3 illustrates the removal of the surface treatment surface applicator from the chamber and the sealing of the object to be treated within the chamber.
Figure 4:
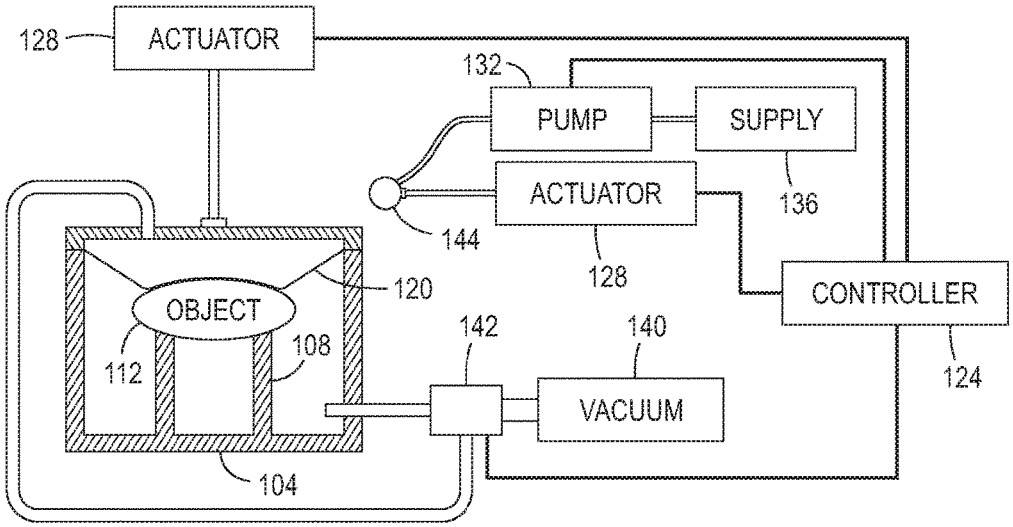
FIG. 4 illustrates the application of a vacuum to the chamber to expand the flexible member within the chamber and conform a portion of the flexible member to the surface of the object.
Figure 5:
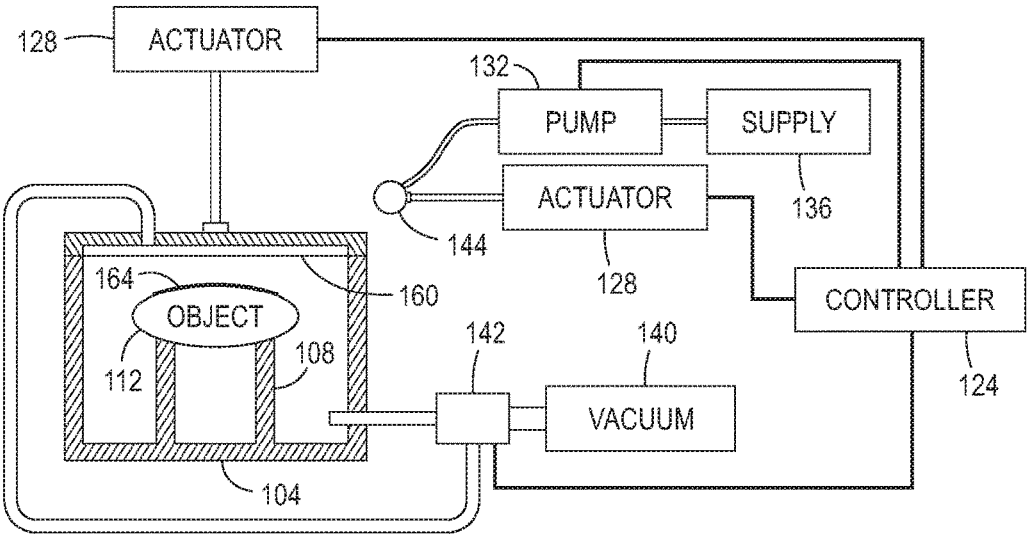
FIG. 5 illustrates the termination of the vacuum and the return of the flexible member to its initial position.
Figure 6:
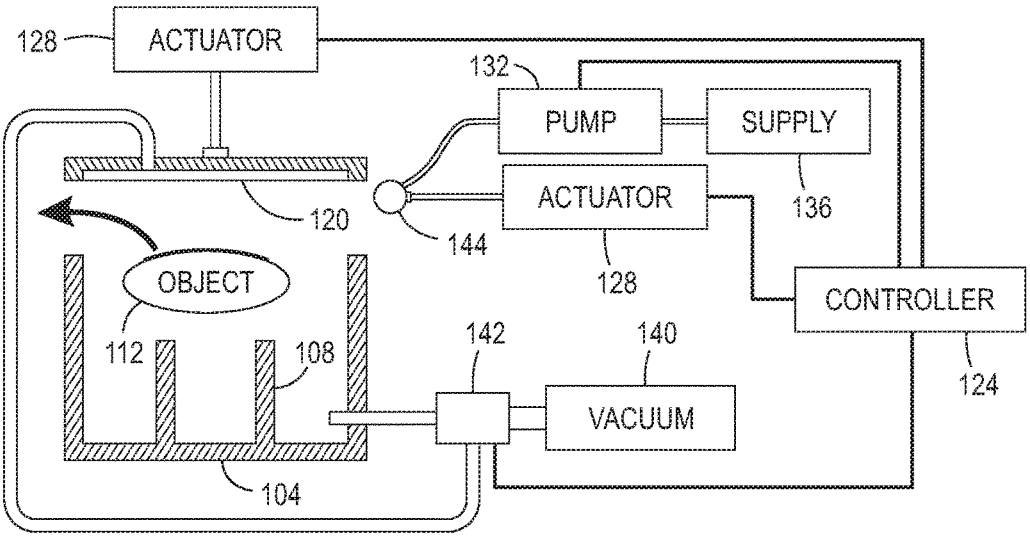
FIG. 6 illustrates the removal of the surface treated object from the system 100.

The controller 124 operates the actuator 128 operatively connected to lid 116 to close the chamber 104 with a seal sufficient to sustain a vacuum within the chamber as shown in FIG. 3. Controller 124 operates the valve 142 to connect the vacuum produced by the source 140 to the chamber 104. This vacuum pulls the flexible member 120 toward the object 112 to engage the surface of the object 112 with the chemical on the surface of the flexible member 120 as shown in FIG. 4. After a predetermined time of engagement between the flexible member and the object, the controller 124 closes the valve 142 to disconnect the vacuum source 140 from the chamber and vents the chamber 104 to ambient pressure. The flexible member 120 has sufficient biasing action that it returns to its position against the lid 116 once the vacuum within the chamber 104 is released. The flexible member 120 is a sheet of material that is flexible enough to conform to irregularities in a 3D object surface without breaking or tearing, but also has sufficient resiliency to return to its initial position when the vacuum is released. Such materials can be any material having these properties and include latex, polyolefin, PVC, polyethylene, polypropelene, and synthetic rubber. Alternatively, the controller 124 can operate the valve 142 to apply the vacuum from vacuum source 140 to the side of the flexible member 120 that is against the lid 116 at the initial position. This embodiment is able to use materials for the flexible member 120 that do not have sufficient resiliency to return the flexible member to the lid 116 without assistance from a vacuum. As the flexible member 120 returns to the lid 116, the chemical film on the flexible member splits so the portion 164 that engaged the object surface remains on the object surface and the remainder 160 stays on the flexible member 120 as shown in FIG. 5. Once the flexible member 120 returns to the lid 116, the controller 124 operates the actuator 128 operatively connected to the lid 116 to lift the lid from the chamber 104 and the object can be removed for printing (FIG. 6).

Figure 7:
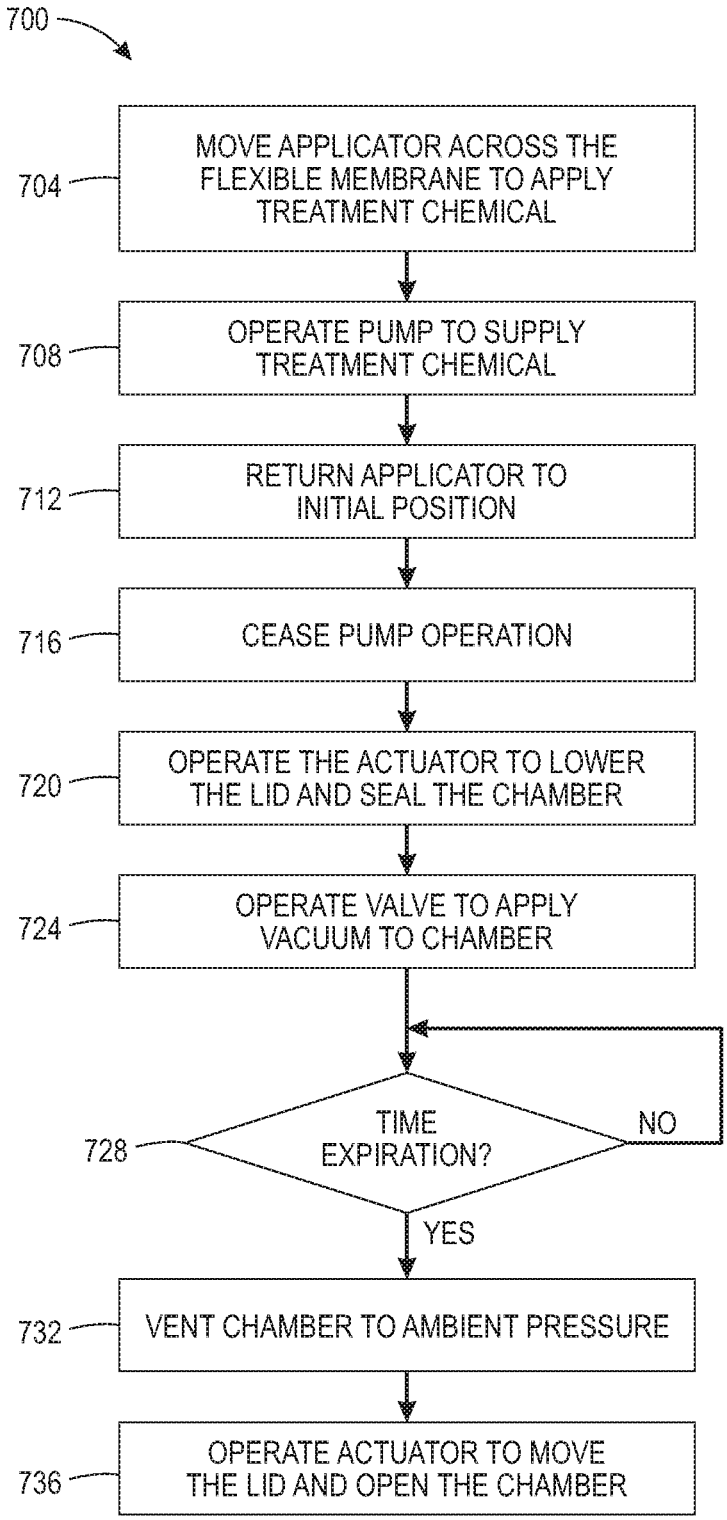
FIG. 7 is a flow diagram of a process for operating the system 100.

A process 700 for operating the system 100 to prepare an object surface for printing is shown in FIG. 7. In the description of the method, statements that the method is performing some task or function refers to a controller or general purpose processor executing programmed instructions stored in non-transitory computer readable storage media operatively connected to the controller or processor to manipulate data or to operate one or more components in the printer to perform the task or function. The controller 124 noted above can be such a controller or processor. Alternatively, the controller can be implemented with more than one processor and associated circuitry and components, each of which is configured to form one or more tasks or functions described herein. Additionally, the steps of the method may be performed in any feasible chronological order, regardless of the order shown in the figures or the order in which the steps are described.

Process 700 begins after an object has been placed within the chamber 104 for treatment by moving the applicator 144 across the surface of the flexible member 120 (block 704). If the chemical source is not contained within the applicator 144, the pump 144 is operated to supply chemicals from the chemical source 136 (block 708). The movement of the applicator is reversed to return the applicator 144 to its initial position (block 712) and operation of the pump 132 is terminated, if it is used to supply the chemical to the applicator, to cease the pumping of treatment chemical to the applicator (block 716). The actuator connected to the lid 116 is operated to close the chamber 104 with a seal sufficient to sustain a vacuum within the chamber (block 720) and the valve 142 is operated to apply the vacuum from source 140 to the chamber 104 (block 724). This vacuum pulls the flexible member 120 toward the object 112 to engage the surface of the object 112 with the chemical on the surface of the flexible member 120. After a predetermined time of engagement between the flexible member and the object (block 728), the vacuum source operation is terminated and chamber 104 is vented to ambient air pressure (block 732) so the flexible member 120 returns to its position against the lid 116 under the biasing action of the flexible member material. Alternatively, after the chamber is vented to release the vacuum within the chamber, the valve 142 can be operated to apply the vacuum from source 140 to the side of the flexible member 120 that is against the lid 116 at the initial position. As the flexible member 120 returns to the lid 116, the chemical film on the flexible member splits so the portion 164 that engaged the object surface remains on the object surface and the remainder 160 stays on the flexible member 120. Once the flexible member 120 returns to the lid 116, the actuator 128 operatively connected to the lid 116 is operated to lift the lid from the chamber 104 (block 736) so the object can be removed for printing.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An object surface treatment system comprising:

an applicator;

a supply of a chemical operatively connected to the applicator;

a pump pneumatically connected between the supply of the chemical and the applicator;

a chamber having walls to form an interior volume, the chamber having a support within the interior volume of the chamber for supporting an object placed within the interior volume of the chamber and a lid configured to close the chamber;

a flexible member mounted to the lid of the chamber;

a vacuum source operatively connected to the interior volume of the chamber;

a plurality of actuators, one of the actuators being operatively connected to the applicator and another of the actuators being operatively connected to the lid; and a controller operatively connected to the pump, the plurality of actuators, and the vacuum source, the controller being configured to operate the one actuator to move the applicator to a surface of the flexible member, to operate the pump to supply the chemical from the supply to the applicator for application to the surface of the flexible member, to operate the other actuator to move the lid to close the chamber, to operate the vacuum source to produce a vacuum within the interior volume of the chamber and move a portion of the surface of the flexible member into engagement with a surface of the object on the support within the interior volume of the chamber, to cease operation of the vacuum source to enable the flexible member to return to a position adjacent the lid, and to operate the other actuator to remove the lid from the chamber to enable removal of the object from the chamber.

2. The object surface treatment system of claim 1, the applicator further comprising:

an internal cavity configured to hold chemical received by the applicator.

3. The object surface treatment system of claim 1 further comprising:

a valve operatively connected between the interior volume of the chamber and the vacuum source and between a side of the flexible member adjacent to the lid and the vacuum source; and the controller is further configured to operate the valve to apply a vacuum produced by the vacuum source to the interior volume of the chamber or to the side of the flexible member adjacent the lid.

4. The object surface treatment system of claim 1 wherein the flexible member is made of a material consisting essentially of polyolefin, PVC, polyethylene, polypropelene, synthetic rubber, or latex.

5. The object surface treatment system of claim 3, the controller being further configured to operate the valve to disconnect the vacuum produced by the vacuum source from the interior volume of the chamber in response to a predetermined time period expiring following engagement of the flexible member with the surface of the object within the chamber.

6. The object surface treatment system of claim 1 wherein the applicator is an anilox roller.

7. The object surface treatment system of claim 1 wherein the vacuum source is configured to produce a vacuum of about 10 psi to about 15 psi in the interior volume of the chamber.

* * * * *